US005096000A

United States Patent [19]

Hesse

[11] Patent Number: 5,096,000

[45] Date of Patent: Mar. 17, 1992

[54] PROCESS AND APPARATUS FOR LAYING SERVICE LINES WITHOUT EXCAVATION

[75] Inventor: Alfons Hesse, Lennestadt, Fed. Rep. of Germany

[73] Assignee: Paul Schmidt, Lennestadt, Fed. Rep. of Germany

[21] Appl. No.: 361,923

[22] Filed: Jun. 6, 1989

[30] Foreign Application Priority Data

Aug. 4, 1988 [DE] Fed. Rep. of Germany ..... 3826513

[51] Int. Cl.[5] ..... E21B 4/14; E21B 7/26

[52] U.S. Cl. ..... 175/22; 175/95; 175/171; 175/296; 405/184

[58] Field of Search ..... 175/22, 19, 51, 53, 175/95, 122, 135, 171, 293, 295, 296, 57, 61, 62; 405/154, 156, 157, 184, 146, 150

[56] References Cited

U.S. PATENT DOCUMENTS 3,805,899 4/1974 Hicks et al. ..... 175/53

4,091,631 5/1978 Cherrington ..... 405/184

4,422,800 12/1983 Parish ..... 405/184

4,662,457 5/1987 Bouplon ..... 175/19

FOREIGN PATENT DOCUMENTS 2157259 11/1972 Fed. Rep. of Germany .

2824915 12/1979 Fed. Rep. of Germany .

*Primary Examiner*—Terry Lee Melius

*Attorney, Agent, or Firm*—Toren, McGeady & Associates

[57] ABSTRACT

In a process for laying underground service lines without excavation by means of a ram boring machine, old pipe lines already buried underground are replaced by new service lines without having to tear up the ground or destroy the old pipe line. To enable the new line to be laid accurately in position and to be accurately targeted the ram boring machine is provided with a guiding bore passing axially through the casing and is guided on the old line.

13 Claims, 3 Drawing Sheets

101
5
4
2
6
24

101
102
10
12
105
11
106

6
3
9
8
1
7
5
2
4
6

PROCESS AND APPARATUS FOR LAYING SERVICE LINES WITHOUT EXCAVATION

TECHNICAL FIELD OF THE INVENTION

The invention relates to a process and a ram boring machine for laying service lines in the ground without excavation by means of a ram boring machine.

BACKGROUND OF THE INVENTION AND PRIOR ART

A pneumatically driven ram boring machine having an impact tip mounted in a cylindrical housing and a percussion piston reciprocating in the housing is known from German patent specification 21 57 259. The automatic piston of this apparatus exerts periodic ramming blows on the movable impact tip. Under the influence of the ramming blows the impact tip, which is supported on the machine housing through a compression spring, oscillates and moves into the ground and, when its stroke is exhausted, finally draws the housing after it.

Such ram boring machines serve primarily to lay service lines such as, for example, electricity or telephone lines or cables under roadways or sidewalks without the need to tear up the surface of the roadway or sidewalk, As the ram boring machine moves through the ground it forces the soil aside and leaves behind it a passage into which a service line can be drawn at the same or some subsequent item. Such a ram boring machine can therefore be provided at its rear end with a connection for fastening a follower pipe, or alternatively a pipe to be laid can be pulled into the passage in the ground by the ram boring machine using a tow rope.

It is known from German patent specification 28 24 915 to use such ram boring machines for the destructive replacement of old lines, for example comprising iron or ceramic pipes. For this purpose the impact tip of the device is provided with cutting or impact knives that project radially outwards. As the impact tip moves forward the cutting edges burst the walls of the old line, though the rubble remains in the ground.

Although the impact tip also breaks up or pushes aside stones and other obstructions in the ground, it is not always possible to avoid the ram boring machine departing from the desired direction when it encounters an obstruction. Such deviations in course are only of minor importance when the bore is short, for example when crossing beneath streets and railway embankments, but they lead to considerable difficulties when precise, directionally accurate boring over long distances is needed. To enable the direction of advance of the ram boring machine to be controlled over bores extending for long distances target pits are therefore dug at suitable distances apart.

OBJECT OF THE INVENTION

An object of the invention is to provide a process and a ram boring machine for carrying out the process that enable an old, already buried service line to be replaced without the above-mentioned disadvantage and without the need to tear up the ground and a new service line to be laid accurately in position or accurately targeted.

SUMMARY OF THE INVENTION

This object can be achieved, according to the process of the invention, by guiding the ram boring mahcine along an old buried service line. Since the ram boring machine thus, as it were, runs along the old line as a rail, or is guided by it, the old line that has been laid in the ground with great care can be employed as a guide line to direct the ram boring machine when laying a new line. A new line or, if the ram boring machine is provided with a suitable adapter, several new lines, can be laid parallel to the old line, if desired at different depths. The old line can even be replaced by a new and larger one without having to destroy the old line and leave its rubble in the ground. For at the same time as it advances the ram boring machine can draw into the ground a protective pipe surrounding the old line, so that after the protective pipe has been introduced all that is needed it to withdraw the freed old line from the protective pipe and replace it with a new one.

A ram boring machine that is suitable for carrying out the process of the invention can be provided with a guiding bore passing axially through the housing. When the ram boring machine is pushed on to the service line it thus slides over the old line that runs through the middle of the machine housing and guides the ram boring machine. In such a ram boring machine the impact piston can be formed as a hollow piston, i.e. with a central opening corresponding to the guiding bore. It is however preferably to arrange at least two impact pistons in the machine housing outside the guiding bore. Instead of a single large-diameter hollow piston with a diameter matching the internal diameter of the housing, two or more correspondingly smaller impact pistons can be used. The guiding bore can advantageously be arranged in a steering shoe that can be coupled to the old line. If the steering shoe extends radially of the machine housing and surrounds the old line with some play, it can be arranged that the sliding of the steering shoe on the old line does not hinder the advance of the ram boring machine, without at the same time impairing the guidance of the ram boring machine along the old line.

The guide piece can connect at least two machine housings lying axially alongside one another and a guiding bore surrounding the service line. In this way two or more machines can be formed into a bundle and a corresponding number of new lines introduced into the ground in a single operation. For the advancing unit there is central guidance because of the old line running through the guiding bore. If the guide piece or the adapter has a pipe connection arranged coaxially of the guiding bore a protective pipe can be fastened thereto, so that at the same time a protective pipe surrounding the old line can be drawn into the ground.

Advantageously there is a pipe connection at the rear end of the machine housing. This enables a protective pipe to be connected to the ram boring machine and to be introduced into the ground in one step as a follower pipe. A thickening of the rear end of the housing has the advantage of enabling the soil to be pushed outwards, which is particularly useful if new large diameter lines are to be laid.

If at least one lubrication line leads to the guiding bore a lubricant can be introduced into the gap between the old service line and the ram boring machine, and thus considerably reduce the friction.

The mouth of the bore can advantageously be formed as an inlet funnel provided with dirt strippers. The narrowing of the inlet funnel counter to the driving direction prevents dirt that falls during the advance of the ram boring machine into the bore in the ground from getting into the gap between the guiding bore of the ram boring machine and the surface of the old line, without destroying the outer surface of the old line.

BRIEF DESCRIPTION OF THE DRAWINGS

The invention will now be described in more detail with reference to exemplary embodiments illustrated in the drawings. In the drawings.

DETAILED DESCRIPTION OF PREFERRED EMBODIMENTS OF THE INVENTION

Figures 1, 2, 3:
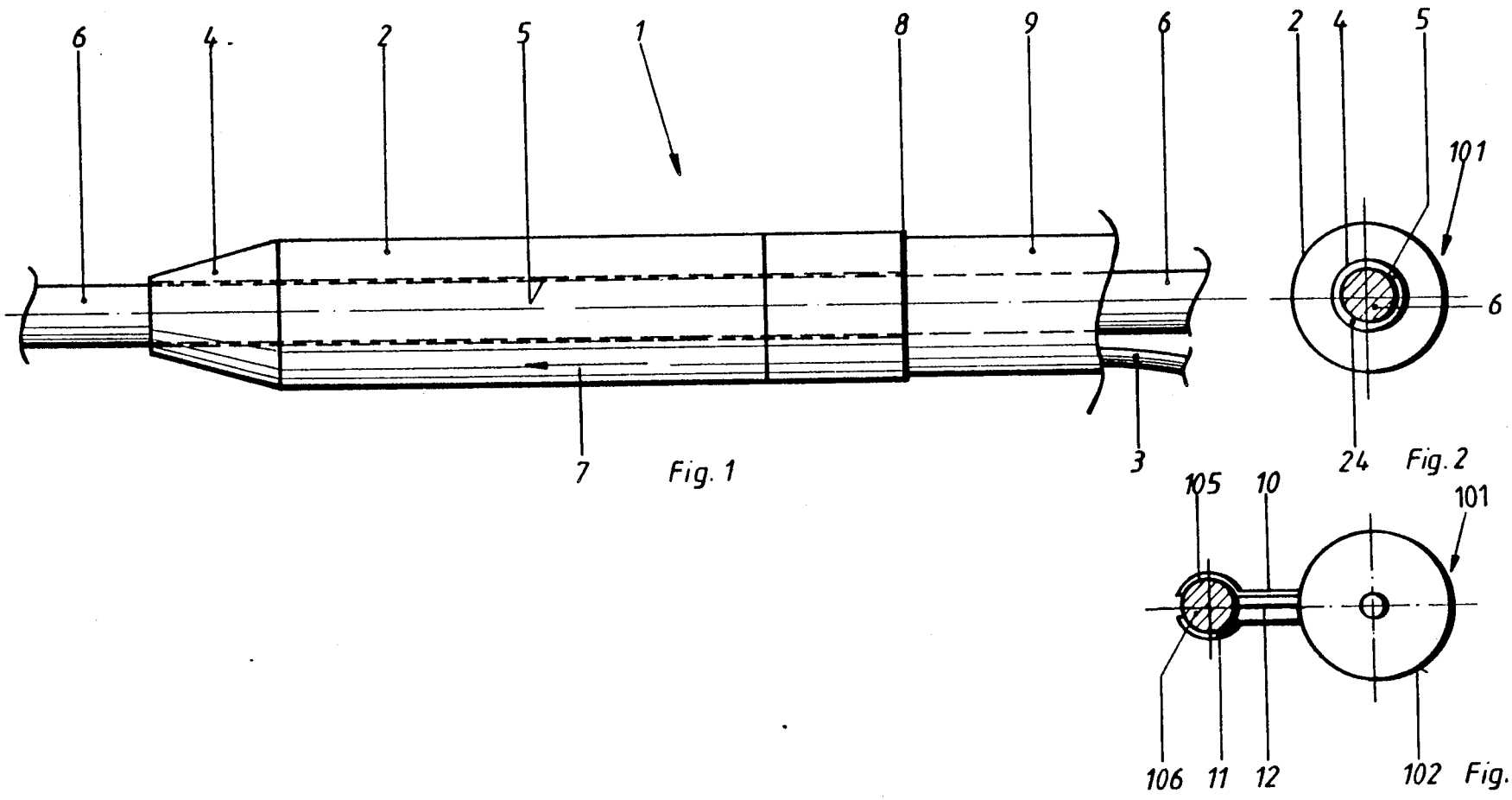
FIG. 1 is a longitudinal section through a ram boring machine having a central guiding bore surrounding an old line.
FIG. 2 shows the ram boring machine of FIG. 1 viewed from the left.
FIG. 3 is a front view of a ram boring machine connected to an old line by a sword-like steering shoe.

The ram boring machine 1 shown in FIG. 1 comprises a housing 2 with an automatic impact piston (not shown) and is supplied with compressed air through a pipeline 3. In the front part of the housing 2 is mounted an impact tip 4. Through an axial guiding bore 5 in the ram boring machine 1 there passes an old line 6, buried in the ground, that guides the ram boring machine 1 as it moves forwards under the blows of the impact piston in the driving direction 7: the impact piston is provided with a central bore adapted to the guiding bore 5, i.e. it is in the form of a hollow or annular piston. The ram boring machine 1 has a pipe connection 8 at its rear end to fasten on a protective pipe 9 which is thus drawn into the ground as a follower pipe as the machine drives forwards.

To replace the old line 6 by a larger diameter new line (not shown) the ram boring machine 1 simply needs to be pushed over the free end of the old line 6, starting from a starting trench or pit. As it advances it then slides over or on the old line 6, which thus, as it were as a rail, serves to guide the ram boring machine 1 in the driving direction 7. Since at the same time the protective pipe 9 is drawn into the ground, the old line at first remains in the protective pipe 9 and can be withdrawn from the protective pipe 9 after the whole length of the protective pipe has been introduced, i.e. after the ram boring machine 1 has reached the target pit, and replaced by a new line. Alternatively the protective pipe can serve as a service pipe.

As shown in FIG. 3, a conventional ram boring machine 101, i.e. one that is not provided with an axial guiding bore, has a radial guide shoe 10 that is provided with a cylindrical opening 11 having a guiding bore 105 to guide the ram boring machine on the old line 106. The end 12 of the guide shoe 10 facing in the direction of advance is wedge-shaped to reduce the ground resistance; for the same reason the opening 11 can be provided with a forward-facing point similar to the impact tip 4 of the ram boring machine 1.

Figure 5:
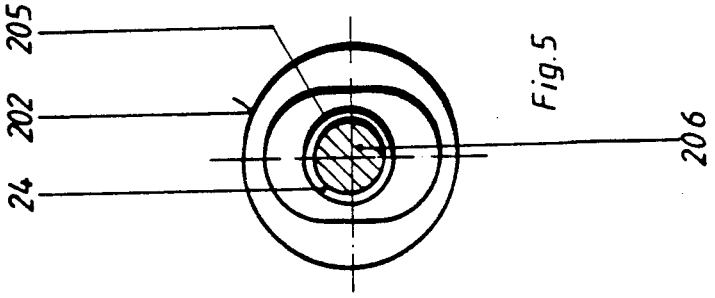
FIG. 5 shows the ram boring machine of FIG. 4 viewed from the left.
Figure 4:
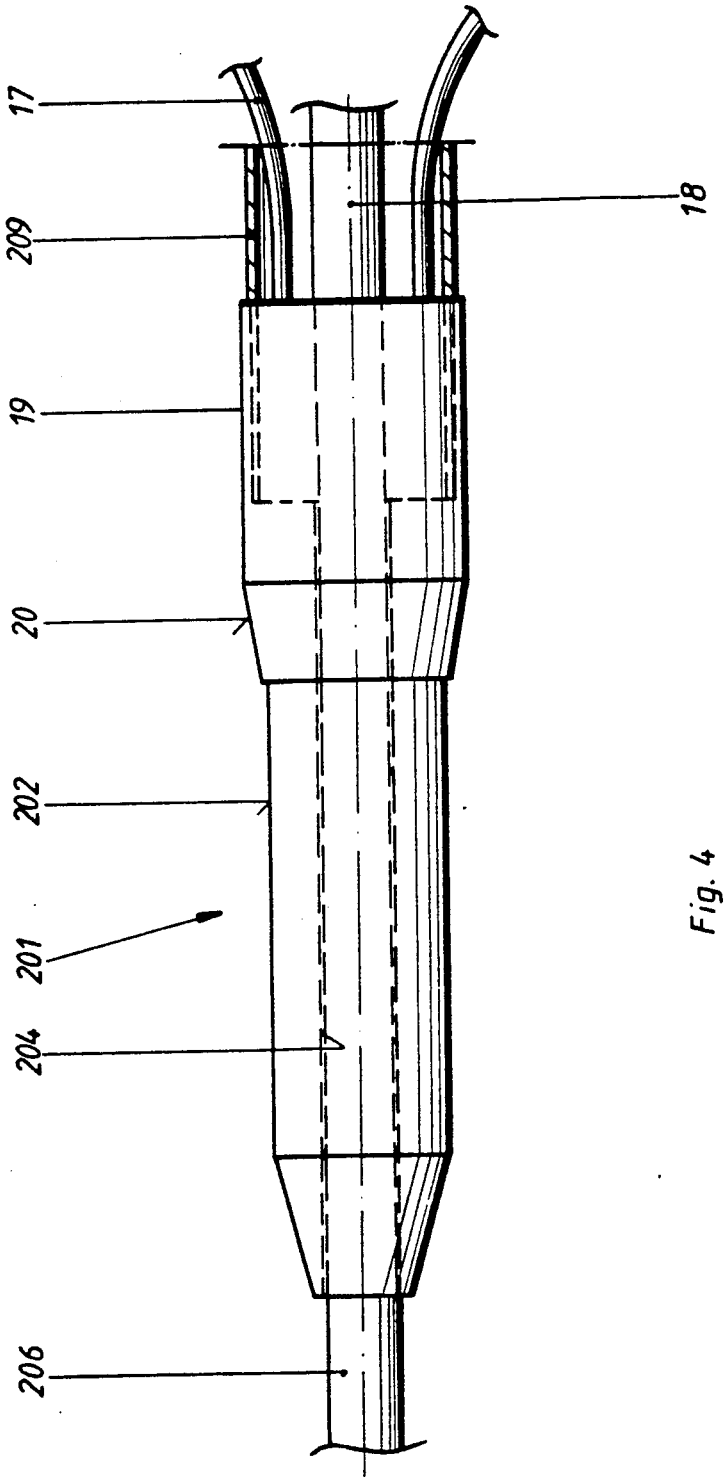
FIG. 4 is a side elevation of a ram boring machine having two impact pistons arranged around a central guiding bore.
Figure 6:
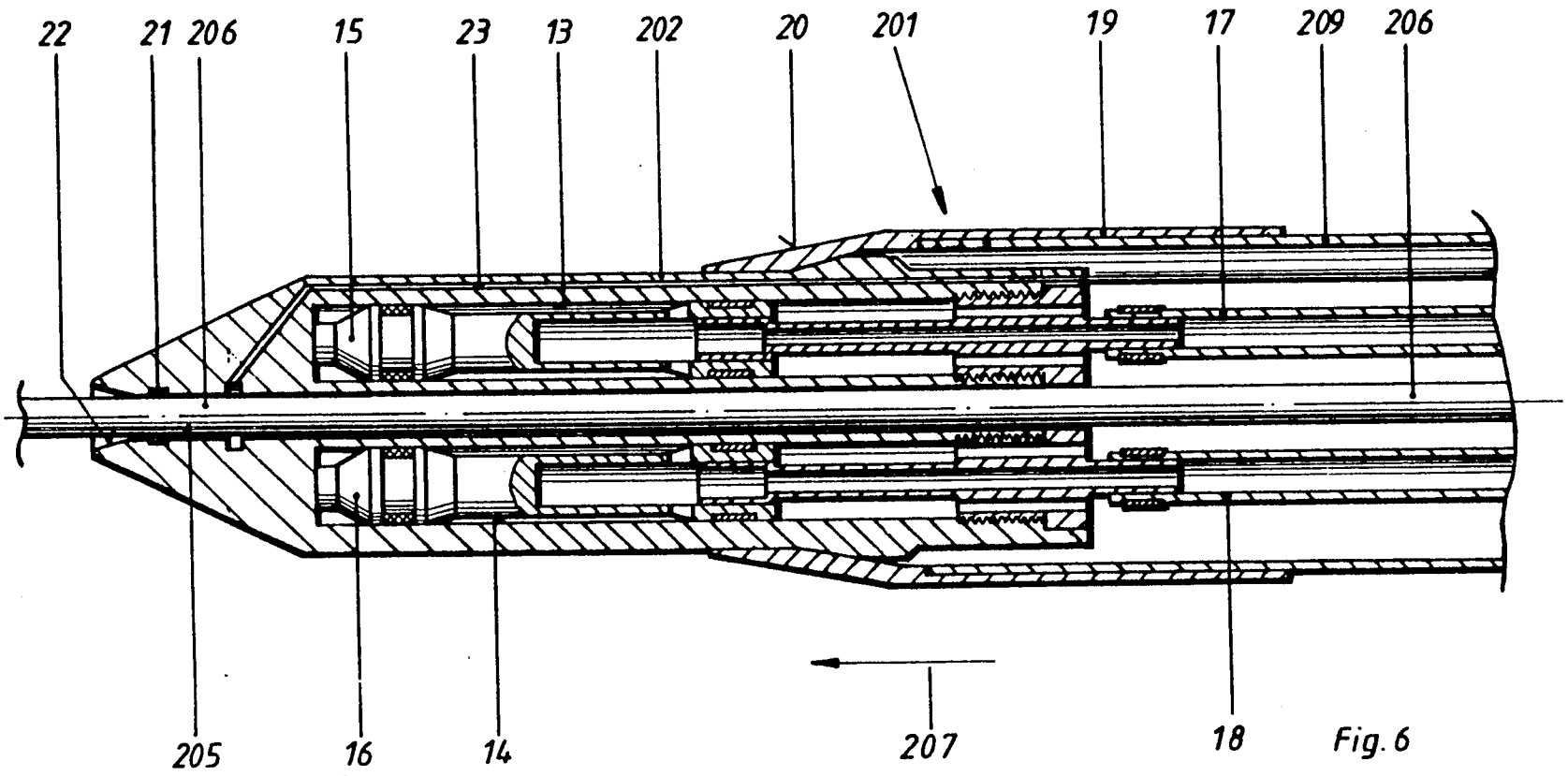
FIG. 6 is a longitudinal section through the front end of the ram boring machine according to FIG. 4.

In the ram boring machine 201 illustrated in FIGS. 4 to 6 there are twin impact pistons 15, 16 arranged to reciprocate in two working chambers 13, 14 parallel to the axial guiding bore 205; these move the ram boring machine 201 as it slides over and is guided by the service line 206 in the forward direction 207. The compressed air is supplied to the impact pistons 15, 16 through hose connections 17, 18 from a compressed air supply (not shown). The rear end of the machine housing 202 consists of a coupling 19 that receives a protective pipe 209 and also has its outer surface 20 thickened so that its diameter is greater than that of the machine housing 202. The surface thickening 20 runs counter to the driving direction 7, i.e. is outwardly conical, and in this way serves to widen the passage in the ground produced by the ram boring machine 201.

As shown in FIG. 6, the ram boring machine 201 has, as the mouth of the axial guiding bore 205, a conical inlet funnel 22 provided with dirt strippers 21. In addition at least one lubricant line 23 runs from the rear end to the axial guiding bore 205. By supplying lubricant into the radial gap 24 between the old line 6, 206 and the guiding bore 5, 205 (cf. FIGS. 2 and 5) the friction between the old line and the ram boring machine can thus be reduced.

What is claimed is:

1. A process for laying underground service lines by using a ram boring machine, comprising:

sliding the ram boring machine from a starting pit through a new, larger-diametered service line onto an old, smaller-diametered service line to be removed, via a guide in the boring machine;

moving the ram boring machine forward along the old lines as a result of blows of a striker piston of the ram boring machine;

guiding the ram boring machine with the old line;

pulling at least a following pipe which embraces the old line, into the ground simultaneously with the forward motion; and withdrawing the old line from the following pipe.

2. A process according to claim 1, including surrounding the old service line with the follower pipe.

3. A process according to claim 1, wherein the follower pipe pulling step includes pulling a plurality of follower pipes in by the ram boring machine.

4. A process as defined in claim 1, wherien the step of moving the machine forward includes the old line forming a rail along which the boring machine travels.

5. A ram boring machine for replacing underground service lines without excavation, comprising:

a housing having a guide bore extending axially there through so that an old service line is passable there through for replacement of the old line;

means for striking and moving the machine forward along the old line;

means for guiding the machine with the old line; and means for pulling a following pipe which embraces the old line into the subsoil simultaneously with the advanced movement of the machine.

6. A ram boring machine according to claim 5, wherein the guiding means includes a guide shoe that can be coupled with the old line, the guiding bore being located in the guide shoe.

7. A ram boring machine according to claim 6 wherein the guide shoe connects at least two housings arranged side by side and has a guiding bore surrounding the service line.

8. A ram boring machine according to claim 5, wherein the means for moving the machine includes at least two impact pistons arranged in the machine housing and outside the guiding bore.

9. A ram boring machine according to claim 5, and further comprising a pipe coupling at the rear end of the housing.

10. A ram boring machine according to claim 5, and further comprising at least one lubrication line which leads to the guiding bore.

11. A ram boring machine according to claim 5, wherein the guiding bore has a mouth formed as an inlet funnel.

12. A ram boring machine according to claim 11 wherein the inlet funnel is provided with at least one dirt stripper.

13. A ram boring machine according to claim 5, wherein the outer surface of the casing is thickened at the rear end of the machine housing.

* * * * *